US009962019B1

(12) United States Patent
Padilla

(10) Patent No.: US 9,962,019 B1
(45) Date of Patent: May 8, 2018

(54) EXTENDABLE FRAME

(71) Applicant: John Paul Padilla, Turlock, CA (US)

(72) Inventor: John Paul Padilla, Turlock, CA (US)

( * ) Notice: Subject to any disclaimer, the term of this patent is extended or adjusted under 35 U.S.C. 154(b) by 0 days. days.

(21) Appl. No.: 15/786,186

(22) Filed: Oct. 17, 2017

Related U.S. Application Data

(60) Provisional application No. 62/408,854, filed on Oct. 17, 2016.

(51) Int. Cl.
*A47G 1/08* (2006.01)
*A47G 1/06* (2006.01)

(52) U.S. Cl.
CPC ..... *A47G 1/06* (2013.01); *A47G 1/0616* (2013.01); *A47G 1/08* (2013.01); *A47G 2001/0677* (2013.01)

(58) Field of Classification Search
CPC ..... A47G 1/08; A47G 1/06; A47G 1/0616
See application file for complete search history.

(56) References Cited

U.S. PATENT DOCUMENTS 306,462 A * 10/1884 Baxter ..... A47G 1/06 40/798
326,744 A 9/1885 Johnson
418,261 A * 12/1889 Wright ..... A47G 1/08 40/739
522,101 A 6/1894 Bohr
715,372 A * 12/1902 Hamersly ..... G03B 17/26 217/61
908,170 A * 12/1908 Van Der Boom ..... A47G 1/08 273/157 R
993,519 A 5/1911 Guth
1,256,518 A * 2/1918 Carlon ..... A47G 1/08 40/739
1,494,136 A * 5/1924 Rybicky ..... A47G 1/08 40/741
1,540,482 A * 6/1925 Landaal ..... A47G 1/08 40/741
1,548,249 A * 8/1925 Binns ..... A47G 1/08 40/741
2,451,207 A 10/1948 Ferguson
2,467,522 A 4/1949 Cooper
4,117,614 A * 10/1978 Bickford ..... A47G 1/08 40/741
5,343,642 A * 9/1994 Magnusson ..... A47G 1/06 40/762

(Continued)

*Primary Examiner* — Gary C Hoge
(74) *Attorney, Agent, or Firm* — Aaron R. Cramer; Cramer Patent & Design, PLLC.

(57) ABSTRACT

An extendable frame having a first frame half having a first frame first side, a first frame second side, a first frame bridge, and a first gap. Also included is a second frame half having a second frame first side, a second frame second side, a second frame bridge, and a second gap. A first handle is affixed to the first frame bridge while a second handle is affixed to the second frame bridge. A first track system extends from the first frame half toward the second frame half while a second tracking system extends from the second frame half toward the first frame half. A pinion track system is disposed between the first track system and the second track system. The first and second frame halves are movable relative to each other via the first track system, the second track system and the pinion track system.

20 Claims, 5 Drawing Sheets

(56) References Cited

U.S. PATENT DOCUMENTS

| | | | | |
|---|---|---|---|---|
| 5,477,628 | A * | 12/1995 | Chen | A47G 1/0616 40/784 |
| 6,604,306 | B1 | 8/2003 | Burroughs et al. | |
| 6,757,997 | B1 | 7/2004 | Burroughs et al. | |
| 8,100,063 | B2 | 1/2012 | Meyers | |

* cited by examiner

EXTENDABLE FRAME

RELATED APPLICATIONS

The present invention was first described in and claims the benefit of U.S. Provisional Application No. 62/408,854 filed Oct. 17, 2016, the entire disclosures of which are incorporated herein by reference.

FIELD OF THE INVENTION

The presently disclosed subject matter is directed to advertising frames. More particularly, it is directed to an extendable, hand-held frame having a central cut-out that is suitable for receiving promotional content.

BACKGROUND OF THE INVENTION

Advertising and promotional activities are often much better received when paired with promoter-delivered content. This is especially true if the promoter is carrying the advertisement on their person while simultaneously delivering the message.

In the prior art promoter-delivered content often took the form of a promoter wearing a uniform or costume that was closely associated with a product being promoted (such as an Army and Navy uniform at an enlistment post). Also known in the prior art is the wearing of advertisement boards ("Eat at Joe's") while walking around the street or sidewalk. These types of promotional advertisements enable a promoter to bring a powerful message or highly focused product information directly to potential consumers.

In addition, it is well known that certain types of advertisement are best delivered personally in a one-on-one commingling scenario. As such the advertisement message board or other advertising facility at such a commingling scenario must be portable, lightweight, easy to manipulate, and eye-catching.

Accordingly, there exists a need for a promotional device by which a promoter can present focused product information directly to potential consumers in a one-on-one commingling scenario. Preferably such a promotional device would be highly portable, easily manipulated, and suitable for being made available at relatively low cost. Ideally such a promotional device would also be highly configurable and flexible and hand-held.

SUMMARY OF THE INVENTION

The principles of the present invention provide for a promotional device by which a promoter can present focused product information directly to potential consumers in a one-on-one commingling scenario. The inventive promotional device is hand-held, highly portable, easily manipulated, highly configurable, flexible in use and suitable for being made available at relatively low cost.

An extendable frame that is in accord with the present invention includes a first frame half having a first frame first side, a first frame second side, a first frame bridge, and a first gap between the first frame first side and the first frame second side. Also included is a second frame half having a second frame first side, a second frame second side, a second frame bridge, and a second gap between the second frame first side and the second frame second side. A first handle is affixed to the first frame bridge while a second handle is affixed to the second frame bridge. A first track system is affixed to and extends from the first frame half toward the second frame half while a second tracking system is affixed to and extends from the second frame half toward the first frame half. A pinion track system is disposed between the first track system and the second track system. The first and second frame halves are movable relative to each other via the first track system, the second track system and the pinion track system between fully open positions and fully closed positions.

The extendable frame produces a central opening between the first frame half and the second frame half when fully closed. Beneficially, the central opening is rectangular. In some embodiments an insert is disposed between the first frame half and the second frame half. In practice the first frame half and the second frame half are mirror images of one another. Beneficially the first frame half and the second frame half have generally "U"-shapes. When the extendable frame is closed the ends of the "U"-shapes abut. The first frame half and second frame half may carry indicia that form a word. In practice the first track system includes a first rack gear while the second track system includes a second rack gear. A pinion gear may ride along the first rack gear and the second rack gear.

Another extendable frame that is in accord with the present invention includes a "U"-shaped first frame half having a first frame first side, a first frame second side, a first frame bridge disposed between the first frame first side and the first frame second side, and a first gap between the first frame first side and the first frame second side. Also included is a "U"-shaped second frame half having a second frame first side, a second frame second side, a second frame bridge disposed between the second frame first side and the second frame second side, and a second gap between the second frame first side and the second frame second side. There is a first handle that is affixed to the first frame bridge and a second handle that is affixed to the second frame bridge. A first track system extends from the first frame half toward the second frame half while a second track system extends from the second frame half toward the first frame half. A pinion system is disposed between the first track system and the second track system. The first and second frame halves are movable relative to each other via the first track system, the second track system and the pinion system from a fully open position to a fully closed position.

The extendable frame produces a central opening between the first frame half and the second frame half when fully closed. Beneficially, the central opening is rectangular. In some embodiments an insert is disposed between the first frame half and the second frame half. In practice the first frame half and the second frame half are mirror images of one (1) another. Beneficially the first frame half and the second frame half have generally "U"-shapes. When the extendable frame is closed the ends of the "U"-shapes abut. The first frame half and second frame half may carry indicia that form a word. In practice the first track system includes a first rack gear while the second track system includes a second rack gear. A pinion gear may ride along the first rack gear and the second rack gear.

Yet another extendable frame that is in accord with the present invention includes a first frame half having a first frame first side with a first aperture, a first frame second side, a first frame bridge disposed between the first frame first side and the first frame second side, and a first gap between the first frame first side and the first frame second side. Also included is a second frame half having a second frame first side with a second aperture, a second frame second side, a second frame bridge disposed between the second frame first side and the second frame second side, and a second gap between the second frame first side and the second frame second side There is a first handle that is affixed to the first frame bridge and a second handle that is affixed to the second frame bridge. A first track system extends from the first frame half toward the second frame half while a second track system extends from the second frame half toward the first frame half. A pinion system is disposed between the first track system and the second track system. Also included is an insert that is disposed between the first frame half and the second frame half.

In that extendable frame is a dowel is connected to the insert. The dowel passes through the first aperture. The first track system beneficially has a first rack gear, the second track system beneficially includes a second rack gear and the first and second rack gears are mechanically connected together by a pinion gear.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
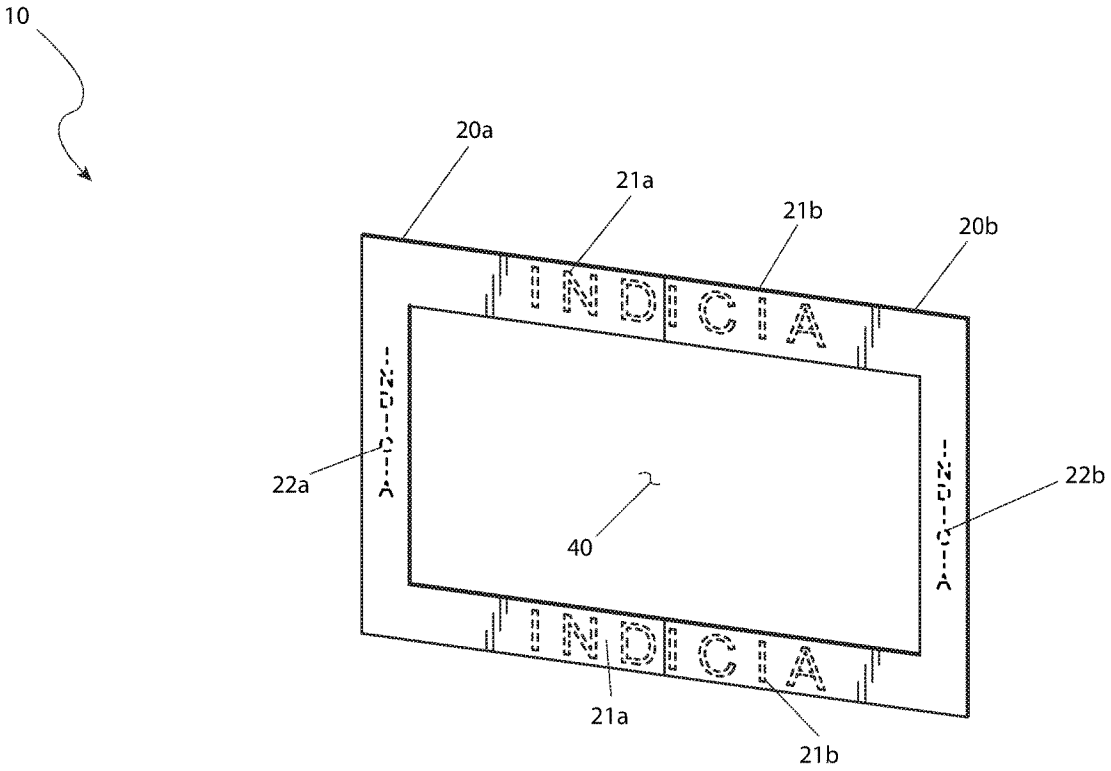
FIG. 1 is a front perspective view of an extendable frame 10 that is in accord with the present invention illustrated in a closed configuration.

10 extendable frame
20*a* first frame half
20*b* second frame half
21*a* first indicia first half
21*b* first indicia second half
22*a* second indicia
22*b* third indicia
25 handle
30 first track system
31 pinon track system
32 second track system
37 first rack gear
38 pinion gear
39 second rack gear
40 central opening
50 insert
51*a* first dowel
51*b* second dowel
51*c* first aperture
51*d* second aperture

DETAILED DESCRIPTION OF THE PREFERRED EMBODIMENT

Figure 4:
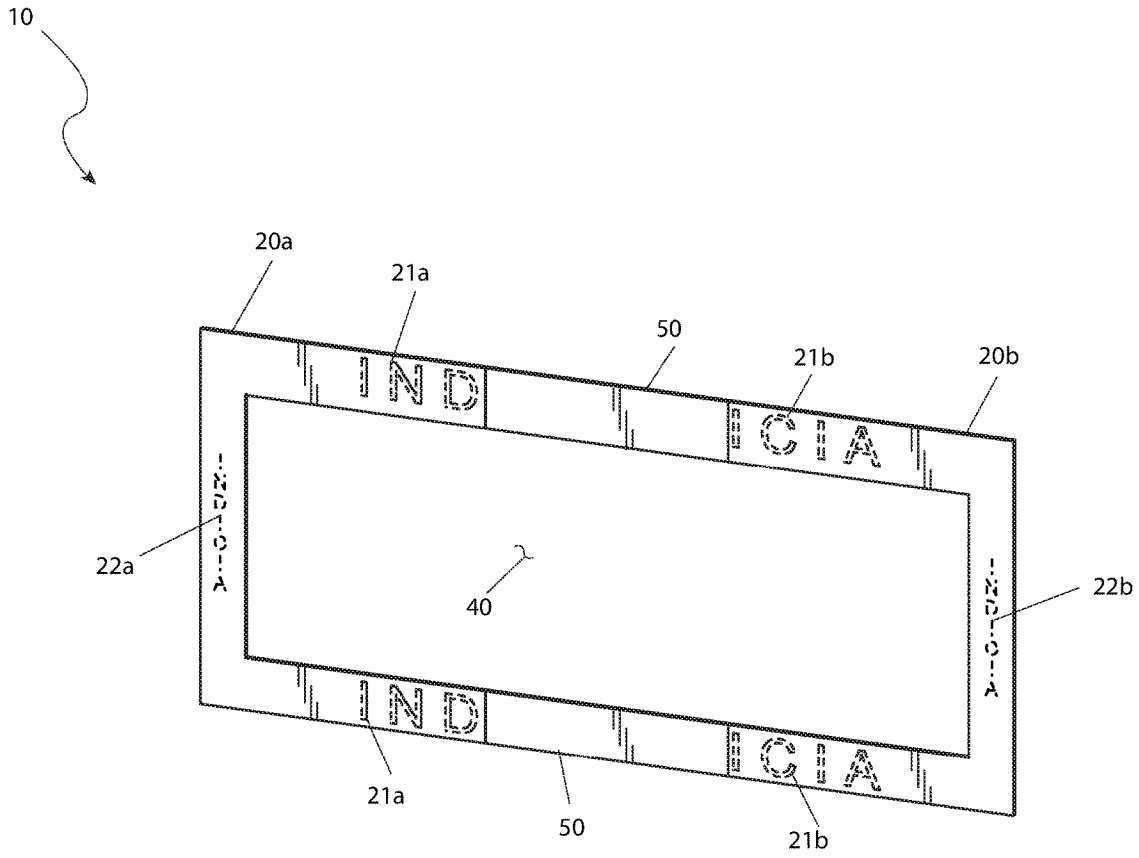
FIG. 4 is a front perspective view of the extendable frame 10 of FIG. 1 in a closed configuration and with a pair of inserts 50 installed; and, FIG. 5 is a close-up perspective view of an individual insert 50.
Figure 5:
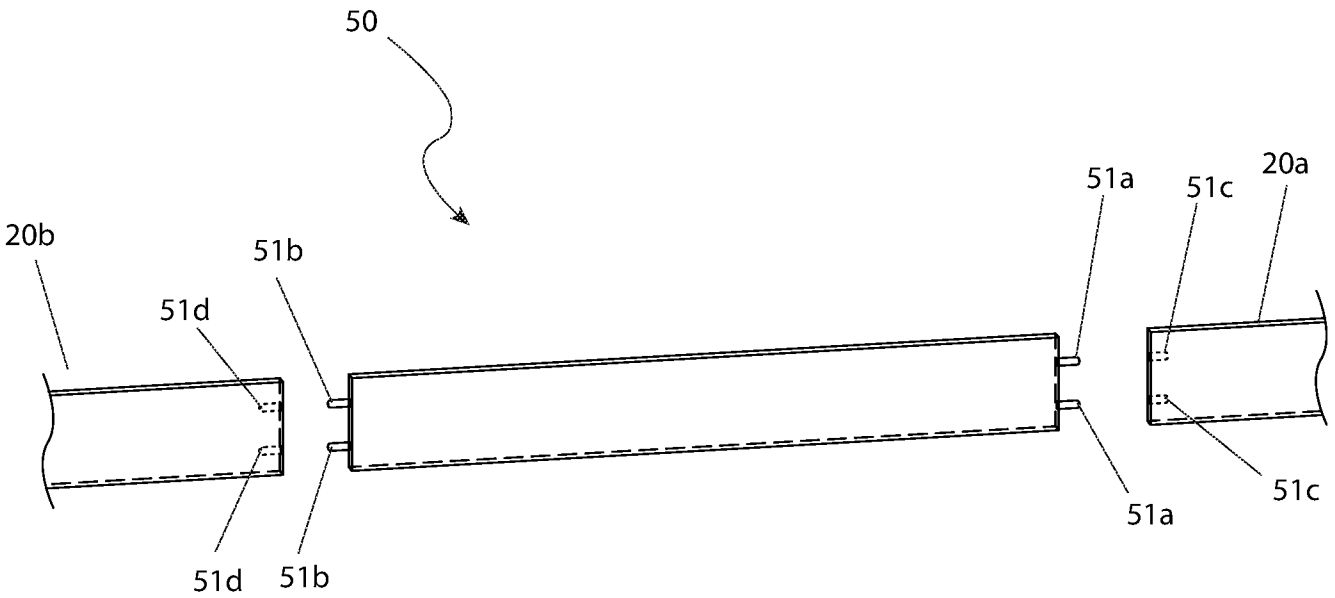

The preferred embodiment of the present invention is depicted in FIGS. 1 through s, and alternately in FIGS. 4 and 5. However, the invention is not limited to the specifically described embodiment. A person skilled in the art will appreciate that many other embodiments of the invention are possible without deviating from the basic concept of the invention. Any such work around will also fall under the scope of this invention.

The terms "a" and "an" as used herein do not denote a limitation of quantity, but rather denote the presence of at least one (1) of the referenced items.

The present invention describes an extendable frame 10 that is suitable for one-on-one advertising. As shown in FIG. 1 the extendable frame 10 includes a central opening 40. It is envisioned that the central opening 40 is dimensioned to enable the head of a person to be seen there through, ostensibly while the extendable frame 10 is held by the person that is being seen. The extendable frame 10 as well as the central opening 40 are preferably rectangular. However, it may be appreciated that other geometric shapes could be used. For ease of use and portability the extendable frame 10 is preferably constructed from a lightweight and weatherproof material.

FIG. 1 depicts the extendable frame 10 when in a closed configuration. The extendable frame 10 includes a first frame half 20*a* and a second frame half 20*b*. The first frame have 20*a* and the second frame have 20*b* are ostensibly identical in shape and size so as to present a mirror image configuration. But it should be appreciated that in some applications either the first frame half 20*a* or the second frame half 20*b* can be slightly larger than the other. In the preferred extendable frame 10 the first frame half 20*a* and the second frame half 20*b* are generally "U"-shaped and are capable of being brought together or extended away from each other via a rack and pinion gears 37, 38, 39 (which are described in more detail below). The ends of the "U"-shapes of the first frame half 20*a* and second frame half 20 beneficially abut together to form the central opening 40.

Adjacent each end of the "U"-shape of the first frame half 20*a* is a first indicia first half 21*a* Similarly, adjacent each end of the "U"-shape of the second frame half 20*b* is a first indicia second half 21*b*. When the first frame half 20*a* abuts the second frame half 20*b* the first indicia first halves 21*a* and the first indicia second halves 21*b* form a first word, phrase, or logo. In addition, the bridge of the first frame half 20*a* includes second indicia 22*a* while the bridge of the second frame half 20*b* includes a third indicia 22*b*. The first indicia halves 21*a*, 21*b*, the second indicia 22*a*, and third indicia 22*b* can all be related to each other. The indicia 21*a*, 21*b*, 22*a*, 22*b* can either be adhered, imprinted, embossed, carved, or otherwise permanently affixed to the frame halves 20*a*, 20*b*. Such indicia 21*a*, 21*b*, 22*a*, 22*b* can also be customizable as necessary.

Figure 2:
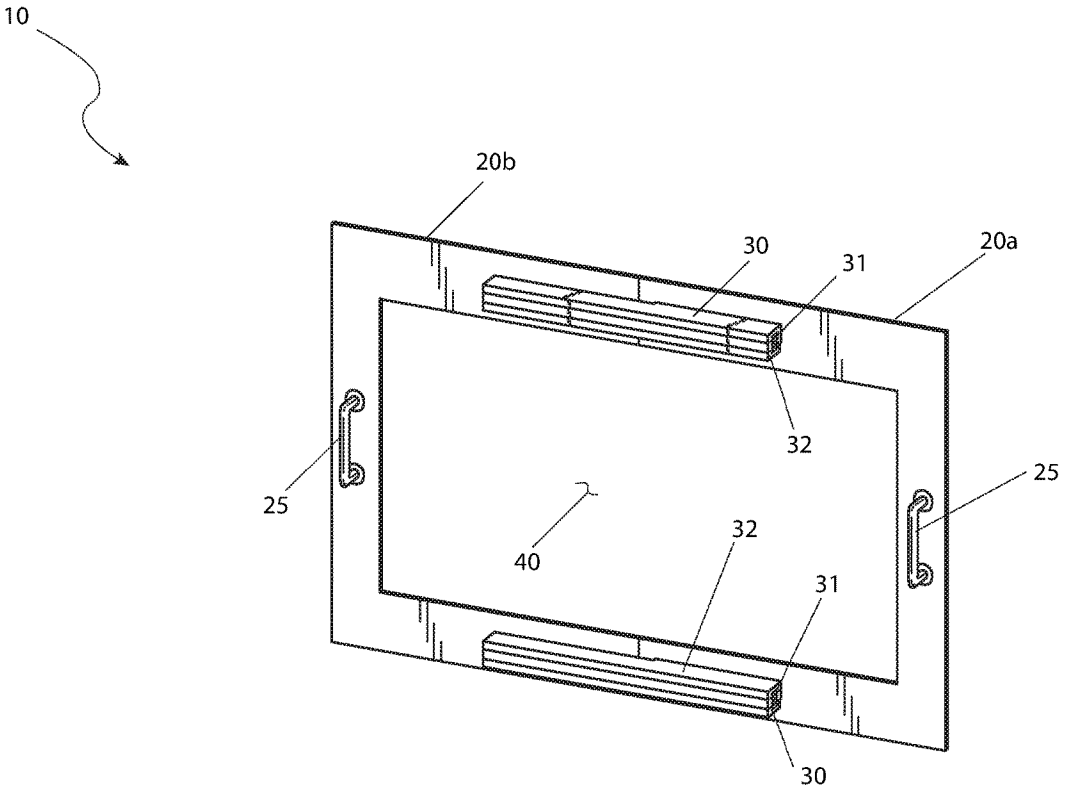
FIG. 2 is a rear perspective view of the extendable frame 10 shown in FIG. 1.

Refer now to FIG. 2 for a rear perspective view of the extendable frame 10. As shown, the backsides of each bridge of the first and second frame halves 20*a*, 20*b* have a vertical handle 25. The handles 25 enable a user to grasp the extendable frame 10 and to move the first and second frame halves 20*a*, 20*b* together or apart. FIG. 2 also shows track systems 30, 31, 32 when the frame 10 is fully closed.

The track systems 30, 31, 32 are located on the backside ends of the first frame half 20*a* and second frame half 20*b*. The first track system 30 is affixed toward the outer perimeter of the first frame half 20*a*. The second track system 32 is affixed toward the inner perimeter of the second frame half 20*b* (near the central opening 40). The pinion track system 31 is affixed to both the first frame half 20*a* and second frame half 20*b* and is in mechanical communication with the first track system 30 and the second track system 32 via a gap between them.

Figure 3:
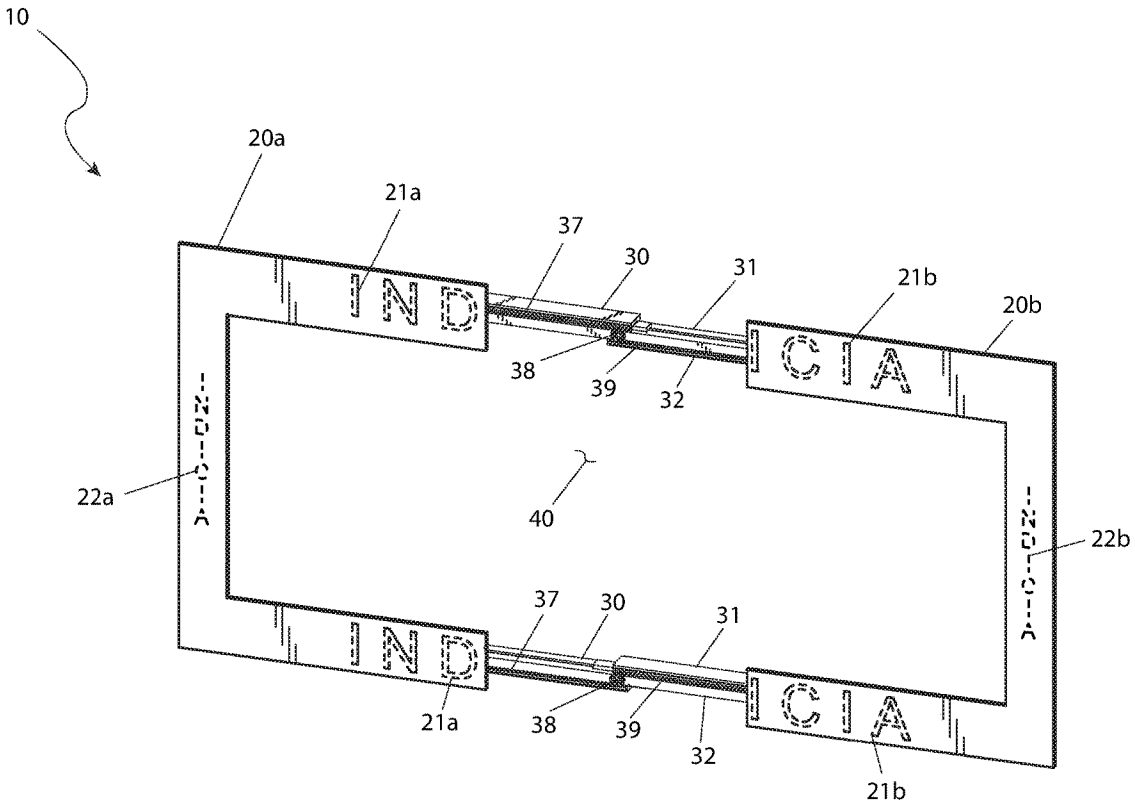
FIG. 3 is a front perspective view of the extendable frame 10 of FIG. 1 and FIG. 2 shown in an open configuration.

Refer now to FIG. 3 for an illustration of the track systems 30, 31, 32 in more detail. The first track system 30 includes a first rack gear 37 while the second track system 32 has a second rack gear 39. The pinion track system 31 includes an independently rotatable pinion gear 38. The pinion gear 38 is in mechanical communication with and rides along the first rack gear 37 and the second rack gear 39. Movement of the first half 20*a* relative to the second half 20*b* translates into movement of the first track system 30 and its first rack gears 37 relative to the pinion gear 38. This causes the first half 20*a* to either move towards or away from the second frame half 20*b*.

FIG. 4 illustrates a pair of inserts 50 that are selectively inserted between the first half 20*a* and second half 20*b*. The inserts 50 preferably have the same thickness and width as the first frame half 20*a* and second frame half 20*b*. The inserts 50 can be inserted between the first frame half 20*a* and the second half 20*b* when the first and second frame halves 20*a*, 20*b* are pulled apart.

FIG. 5 more clearly shows an individual insert 50. The inserts 50 may possess attachment features that enable attachment to the first frame half 20*a* and to the second frame half 20*b*, such as pegs or dowels that are inserted into apertures. A major benefit of the inserts 50 is that they can cover and protect the first rack gear 37, pinion gear 38, and second rack gear 39 from the environment. Two (2) dowels 51*a* extend away from first side of an insert 50 into two (2) apertures 51*c* in the first frame half 20*a*. Two (2) dowels 51*b* extend away from the second side of an insert 50 into two (2) apertures 51*d* in the second frame half 20*b*.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An extendable frame, comprising:

a first frame half having a first frame first side, a first frame second side, a first frame bridge, and a first gap between said first frame first side and said first frame second side;

a second frame half having a second frame first side, a second frame second side, a second frame bridge, and a second gap between said second frame first side and said second frame second side;

a first handle affixed to said first frame bridge;

a second handle affixed to said second frame bridge;

a first track system extending from said first frame half toward said second frame half;

a second track system extending from said second frame half toward said first frame half; and, a pinion track system disposed between said first track system and said second track system;

wherein said first and second frame halves are movable relative to each other via said first track system, said second track system and said pinion track system between a fully open position and a fully closed position.

2. The extendable frame according to claim 1, wherein when in said fully closed position said first gap and said second gap form a central opening.

3. The extendable frame according to claim 2, wherein said central opening is rectangular.

4. The extendable frame according to claim 2, further including an insert disposed between said first frame half and said second frame half.

5. The extendable frame according to claim 1, wherein said first frame half and said second frame half are mirror images of one another.

6. The extendable frame according to claim 2, wherein said first frame half and said second frame half have generally "U"-shapes.

7. The extendable frame according to claim 6, wherein ends of said "U"-shapes abut.

8. The extendable frame according to claim 7, wherein said first frame half and second frame half carry indicia that form a word.

9. The extendable frame according to claim 1, wherein said first track system includes a first rack gear and said second track system includes a second rack gear.

10. The extendable frame according to claim 1, wherein said pinion track system rides along said first rack gear and said second rack gear.

11. An extendable frame, comprising:

a "U"-shaped first frame half having a first frame first side, a first frame second side, a first frame bridge disposed between said first frame first side and said first frame second side, and a first gap between said first frame first side and said first frame second side;

a "U"-shaped second frame half having a second frame first side, a second frame second side, a second frame bridge disposed between said second frame first side and said second frame second side, and a second gap between said second frame first side and said second frame second side;

a first handle affixed to said first frame bridge;

a second handle affixed to said second frame bridge;

a first track system extending from said first frame half toward said second frame half;

a second track system extending from said second frame half toward said first frame half; and, a pinion system disposed between said first track system and said second track system;

wherein said first and second frame halves are movable relative to each other via said first track system, said second track system and said pinion system from a fully open position to a fully closed position.

12. The extendable frame according to claim 11, wherein when in said fully closed position said first gap and said second gap form a central opening.

13. The extendable frame according to claim 12, wherein said central opening is rectangular.

14. The extendable frame according to claim 11, wherein said first frame half and said second frame half are mirror images.

15. The extendable frame according to claim 11, wherein said first frame half and second frame half carry indicia that form a word.

16. The extendable frame according to claim 11, wherein said first track system includes a first rack gear and said second track system includes a second rack gear.

17. The extendable frame according to claim 16 wherein said pinion track system rides along said first rack gear and said second rack gear.

18. An extendable frame, comprising:

a first frame half having a first frame first side with a first aperture, a first frame second side, a first frame bridge disposed between said first frame first side and said first frame second side, and a first gap between said first frame first side and said first frame second side;

a second frame half having a second frame first side with a second aperture, a second frame second side, a second frame bridge disposed between said second frame first side and said second frame second side, and a second gap between said second frame first side and said second frame second side;

a first handle affixed to said first frame bridge;

a second handle affixed to said second frame bridge;

a first track system extending from said first frame half toward said second frame half;

a second track system extending from said second frame half toward said first frame half;

a pinion system disposed between said first track system and said second track system; and, an insert disposed between said first frame half and said second frame half.

19. The extendable frame according to claim 18, further including a dowel connected to said insert which passes through said first aperture.

20. The extendable frame according to claim 18, wherein said first track system includes a first rack gear, said second track system includes a second rack gear, and said first and second rack gears are mechanically connected together by a pinion gear.

* * * * *